US010655621B2

(12) United States Patent
Chen et al.

(10) Patent No.: US 10,655,621 B2
(45) Date of Patent: May 19, 2020

(54) CONTROL SYSTEM AND METHOD OF A VFD-BASED PUMP AND PUMP SYSTEM

(71) Applicants: EATON CORPORATION, Cleveland, OH (US); Yilun Chen, Shanghai (CN); Xiaomeng Cheng, Shanghai (CN)

(72) Inventors: Yilun Chen, Shanghai (CN); Xiaomeng Cheng, Shanghai (CN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 361 days.

(21) Appl. No.: 14/899,992

(22) PCT Filed: Jun. 27, 2014

(86) PCT No.: PCT/CN2014/080970
§ 371 (c)(1),
(2) Date: Dec. 18, 2015

(87) PCT Pub. No.: WO2014/206339
PCT Pub. Date: Dec. 31, 2014

(65) Prior Publication Data

US 2018/0080443 A1 Mar. 22, 2018

(30) Foreign Application Priority Data

Jun. 28, 2013 (CN) ..... 2013 1 0265564

(51) Int. Cl.
*F04B 49/06* (2006.01)
*F04B 17/03* (2006.01)
(Continued)

(52) U.S. Cl.
CPC ..... *F04B 49/06* (2013.01); *F04B 17/03* (2013.01); *F04B 49/065* (2013.01); *F04B 49/08* (2013.01);
(Continued)

(58) Field of Classification Search
CPC .... F04B 49/06; F04B 49/065; F04B 2205/13; F04B 2203/0201; F04B 49/20; F04B 2201/1208; F04B 49/08; F04B 17/03; F04B 2203/0204
See application file for complete search history.

(56) References Cited

U.S. PATENT DOCUMENTS 4,810,168 A 3/1989 Nogami et al.
4,822,250 A 4/1989 Tsubouchi et al.
(Continued)

FOREIGN PATENT DOCUMENTS

CN 10-159743 A 6/1998
CN 201057139 Y 5/2008
(Continued)

OTHER PUBLICATIONS

International Search Report for corresponding International Patent Application No. PCT/CN2014/080970 dated Sep. 17, 2014.
(Continued)

*Primary Examiner* — Bryan M Lettman
(74) *Attorney, Agent, or Firm* — Merchant & Gould P.C.

(57) ABSTRACT

A control system and method of a VFD-based pump. The control system controls an electric motor via a VFD, and the electric motor drives the pump. The control system comprises: an anti-ripple injection module for injecting an anti-ripple signal into a control path, the anti-ripple signal causing pressure ripples in the pump output to be at least partially cancelled. Further a pump system, comprising: a VFD, an electric motor, and a pump, wherein the VFD comprises the control system stated above.

14 Claims, 8 Drawing Sheets

(51) Int. Cl.
*F04B 49/08* (2006.01)
*F04B 49/20* (2006.01)

(52) U.S. Cl.
CPC ..... *F04B 49/20* (2013.01); *F04B 2203/0201* (2013.01); *F04B 2203/0204* (2013.01); *F04B 2205/13* (2013.01)

(56) References Cited

U.S. PATENT DOCUMENTS

| | | | | |
|---|---|---|---|---|
| 5,668,457 | A * | 9/1997 | Motamed | F04B 49/065 318/606 |
| 5,971,714 | A | 10/1999 | Schaffer et al. | |
| 6,018,957 | A * | 2/2000 | Katra | F04B 41/06 62/175 |
| 6,109,878 | A | 8/2000 | Barton et al. | |
| 9,328,727 | B2 * | 5/2016 | Koehl | F04D 15/0088 |
| 2009/0304523 | A1 | 12/2009 | Morsch et al. | |
| 2010/0021313 | A1 * | 1/2010 | Devan | F04B 49/20 417/44.1 |
| 2013/0151216 | A1 | 6/2013 | Palka et al. | |
| 2013/0183167 | A1 * | 7/2013 | Werner | F04B 49/022 417/53 |

FOREIGN PATENT DOCUMENTS

| | | | |
|---|---|---|---|
| JP | 7-286584 | A | 10/1995 |
| WO | WO2011113023 | * | 9/2011 |

OTHER PUBLICATIONS

Extended European Search Report for Application No. 14818247.0 dated Dec. 23, 2016.

* cited by examiner

CONTROL SYSTEM AND METHOD OF A VFD-BASED PUMP AND PUMP SYSTEM

CROSS-REFERENCE TO RELATED APPLICATION

This application is a National Stage Application of PCT/CN2014/080970, filed 27 Jun. 2014, which claims benefit of Serial No. 201310265564.3, filed 28 Jun. 2013 in China and which applications are incorporated herein by reference. To the extent appropriate, a claim of priority is made to each of the above disclosed applications.

FIELD OF THE INVENTION

This invention relates to a pump, particularly to a control system and method of a VFD-based pump, as well as a pump system.

BACKGROUND OF THE INVENTION

Flow ripples or pressure ripples (fluctuations) generated from the hydraulic pump are the source of system vibrations and noises in a hydraulic system. Pressure ripples are also disturbance to motion control that affects the precision and repeatability of the movement.

FIG. 1 illustrates structures and flow ripple patterns of different types of hydraulic pumps. As shown, for the external gear pump, axial piston pump and vane pump, although the required flows are constant, the actual flows fluctuate with rotation of the pumps, which is caused by the mechanical structures of the pumps.

Noises impact human hearing health; vibrations reduce the reliability of the entire system; and the reduced precision directly affects the product quality produced by the hydraulic machine. From every aspect, pressure ripples reduce values delivered to customers. Therefore, pressure ripple reduction has been a core issue that researchers in both academic and industry world have tried to solve.

Most current methods for reduction of flow and pressure ripples are based on novel mechanical designs or additional ripple compensators such as silencers or accumulators. These methods in general suffer from trade-offs among the costs, energy efficiency and system dynamic responses. For example, the method modifying pump shaft design lowers the energy efficiency; adding a pre-compression chamber increases manufacturing and component costs and reduces the efficiency; adding an accumulator or silencer at the pump outlet increases component costs and space, and lowers pump dynamics.

Thus, a solution for reducing noises and vibrations of a pump with higher efficiency and lower costs is needed in the art.

SUMMARY OF THE INVENTION

In one aspect of the present invention, there is provided a control system of a VFD-based pump, the control system controlling an electric motor via a VFD, the electric motor driving the pump, the control system comprising: an anti-ripple injection module for injecting an anti-ripple signal into a control path, the anti-ripple signal causing pressure ripples in the pump output to be at least partially cancelled.

In another aspect of the present invention, there is provided a control method of a VFD-based pump, the control method controlling an electric motor via a VFD, the electric motor driving the pump, the control method comprising:

injecting an anti-ripple signal into a control path, the anti-ripple signal causing pressure ripples in the pump output to be at least partially cancelled.

In yet another aspect of the present invention, there is provided a pump system, comprising: a VFD, an electric motor, and a pump, wherein the VFD comprises the control system above of the present invention.

Advantages of the present invention comprise at least one of the following: effectively reducing noises and vibrations of the pump system, increasing the control precision, stability, repeatability and service life of the system; enhancing customer values; being a low-cost solution; not harming dynamics of the system; needing no additional components and extra space.

BRIEF DESCRIPTION OF THE ACCOMPANYING DRAWINGS

DETAILED DESCRIPTION OF EXEMPLARY EMBODIMENTS

The embodiments of the present invention are described below by referring to figures. Numerous details are described below so that those skilled in the art can comprehensively understand and realize the present invention. However, it is apparent for those skilled in the art that the realization of the present invention may not include some of the details. In addition, it should be understood that the present invention is not limited to the described specific embodiments. On the contrary, it is contemplated that the present invention can be realized using any combination of the features and elements described below, no matter whether they relate to different embodiments or not. Therefore, the following aspects, features, embodiments and advantages are only for explanation, and should not be taken as elements of or limitations to the claims, unless explicitly stated otherwise in the claims.

Figure 1:
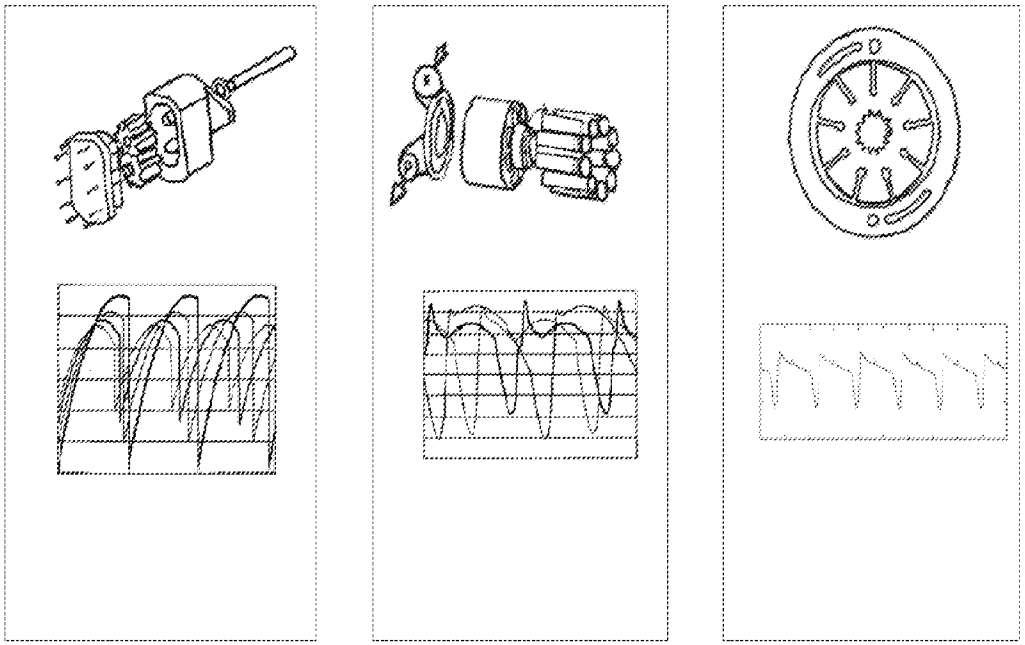
FIG. 1 illustrates the structures and flow ripple patterns of different types of hydraulic pumps.
Figure 2:
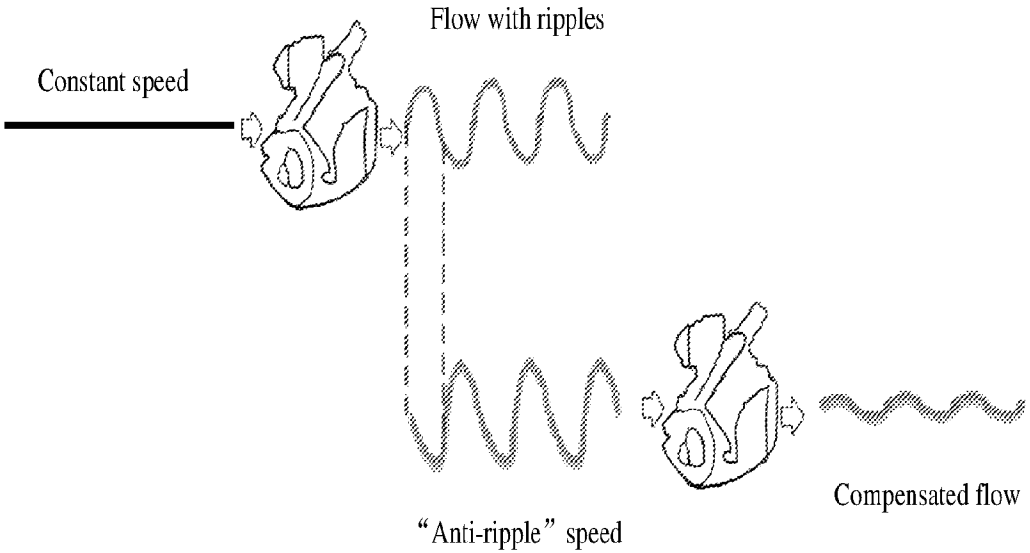
FIG. 2 illustrates the basic idea of the present invention.

In view that currently more and more hydraulic pumps are driven by VFDs to achieve flexible speed or torque control, the present invention proposes a solution of reducing noises and vibrations of a hydraulic pump by means of a control solution applied to the VFD, which does not need additional hardware costs. FIG. 2 illustrates the basic idea of the present invention. As shown, the hydraulic pump system receives a constant rotation speed signal, but generates a liquid flow with ripples. The solution of the present invention injects an anti-ripple signal into the control system of the hydraulic pump such that ripples in the flow outputted by the hydraulic pump are notably cancelled.

Figure 3:
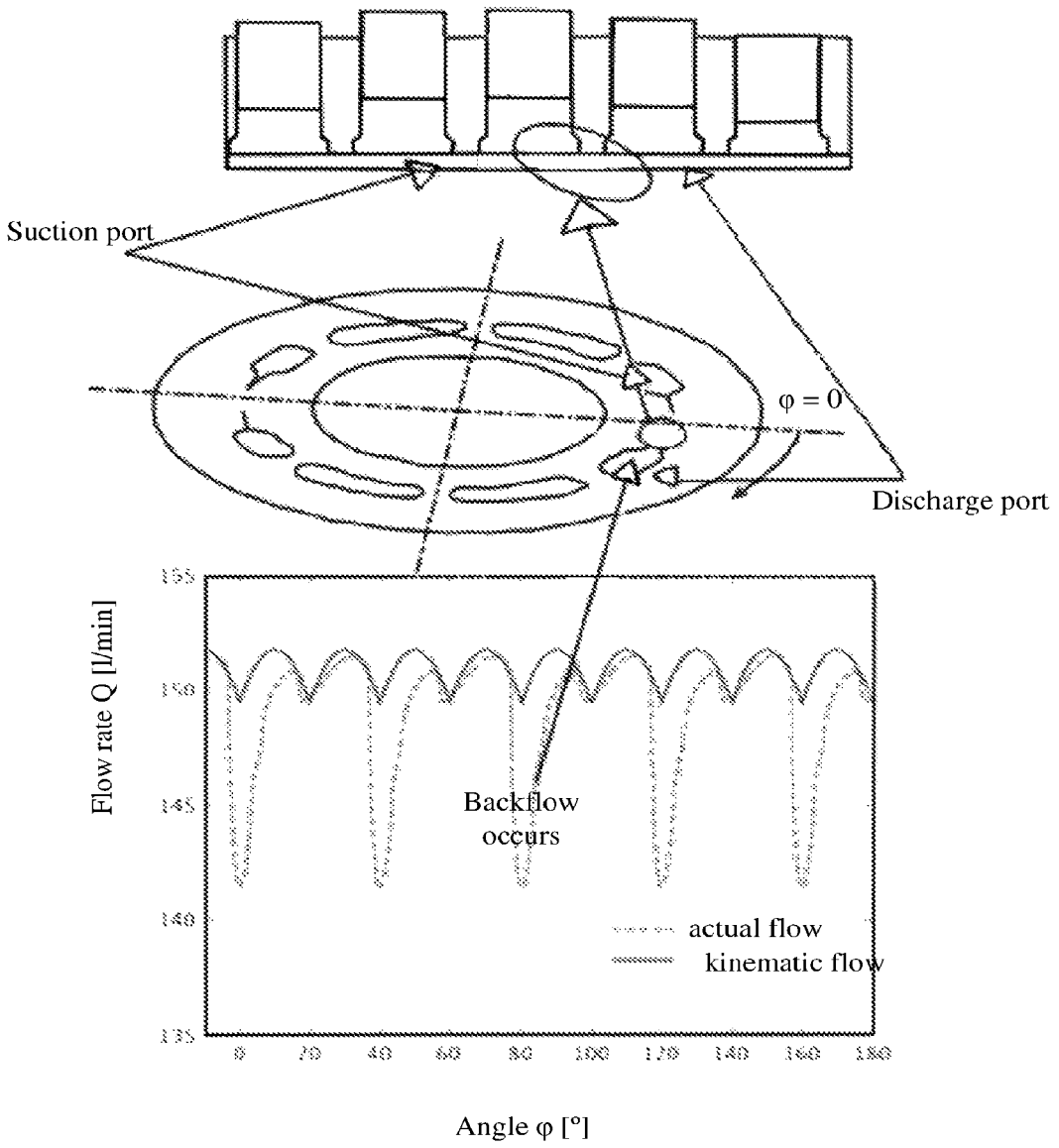
FIG. 3 illustrates the principle of generating flow ripples by a piston pump.

FIG. 3 schematically illustrates the principle of generating flow ripples by a piston pump. As shown, when the piston is rotating at a constant speed, the instantaneous flow rate it generates is not constant but with significant variations. This is due to the mechanical characteristics of the valve plate structure of the piston pump. As shown in FIG. 3, a significant backflow occurs when the piston passes the damping grooves, thus causing flow ripples. Such flow ripples in turn generate pressure ripples, which travels all along the hydraulic circuit. Flow ripples are more fundamental but not easily to be captured by sensors. In contrast, pressure sensors are common, and easy to be obtained and installed.

The instantaneous flow rate at the pump outlet can be expressed in the following equation:

$$\begin{cases} q_{total} = q_a + q_k + q_b \\ q_a + q_k \propto \omega \\ q_b \propto A\sqrt{p_H + p_L} \end{cases}$$

wherein, $q_{total}$ represents the total flow rate; $q_a$ represents the average flow rate; $q_k$ represents the kinematic flow variations; $q_b$ represents the flow ripples generated by the backflow; ω represents the rotation speed of the pump (i.e. the rotation speed of the electric motor); A represents the equivalent cross-sectional area of the piston cylinder; $p_h$ represents the high pressure when backflow occurs; and $p_l$ represents the low pressure when backflow occurs.

The kinematic flow variations represented by $q_k$ are flow ripples caused by the non-linear movement of the piston in the piston cylinder. As shown in the figure, the amplitude of such ripples is small, so the sum of $q_a$ and $q_k$ is approximately a constant value in proportion to the rotation speed of the pump. And the amplitude of the flow ripples (represented by $q_b$) generated by the backflow is large, which is a main source of noises and vibrations in the piston pump, and mainly depends on the pressure characteristics of the fluid in the pump, specifically, in proportion to the difference between the high pressure and the low pressure when the backflow occurs. The basic idea of the present invention with respect to a piston pump can be simply summarized as: increasing the rotation speed of the electric motor when the backflow occurs, which is illustrated schematically in FIG. 8.

Figure 8:
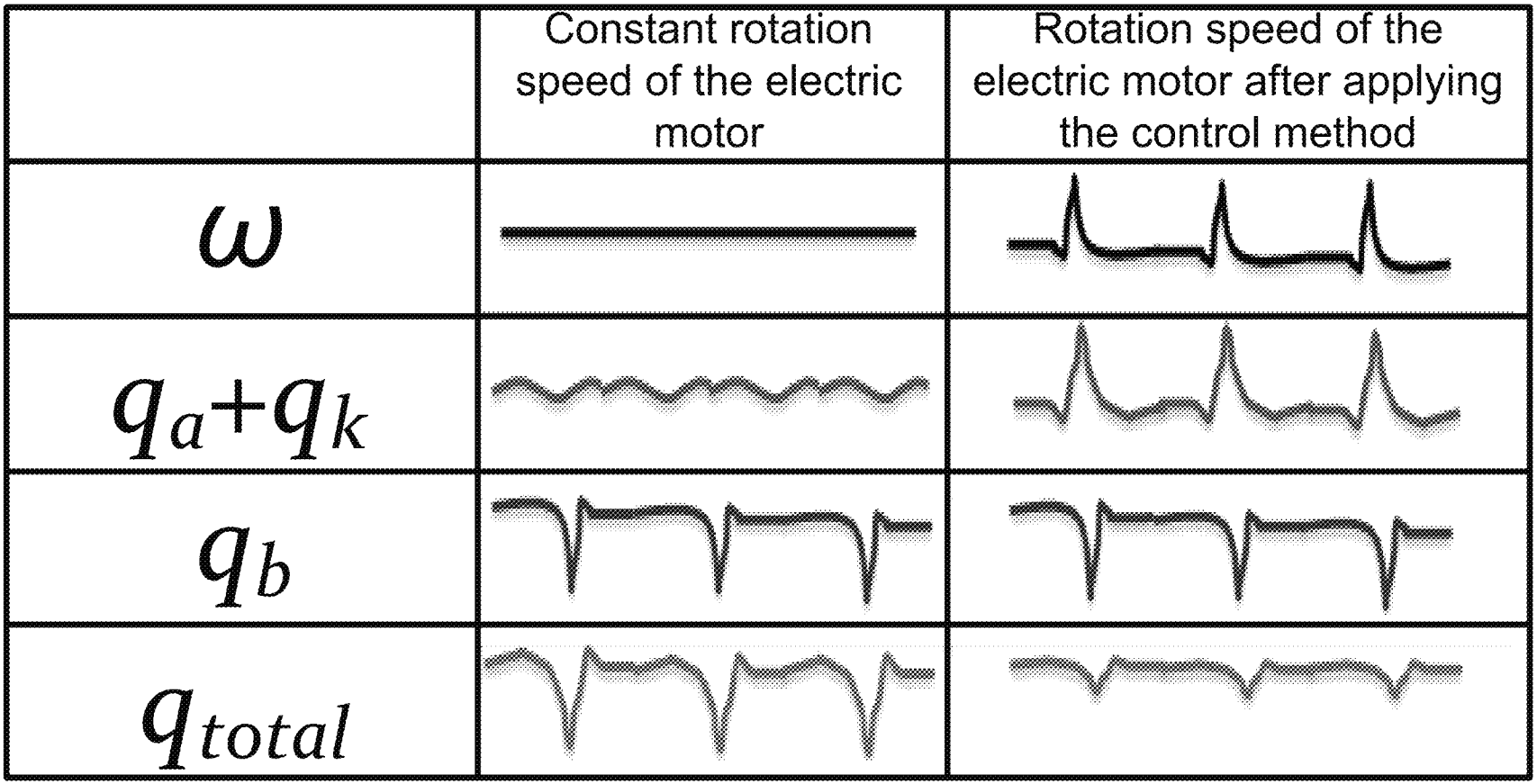
FIG. 8 illustrates a table comparing ripple amplitudes before and after injecting an anti-ripple signal.

As shown in FIG. 8, when the rotation speed signal of the electric motor is constant, the sum of $q_a$ and $q_k$ is basically constant, but the ripple amplitude of $q_b$ is large such that the ripple amplitude of $q_{total}$ is also large. After injecting an anti-ripple signal according to a method of the present invention, a ripple having about the same amplitude but opposite direction will be present in the rotation speed signal of the electric motor such that such ripples will also be present in the sum of $q_a$ and $q_k$. Thus, when the sum of $q_a$ and $q_k$ is added with $q_b$, the ripples in the two will be cancelled with each other such that the ripple amplitude of $q_{total}$ is remarkably reduced.

Figure 4:
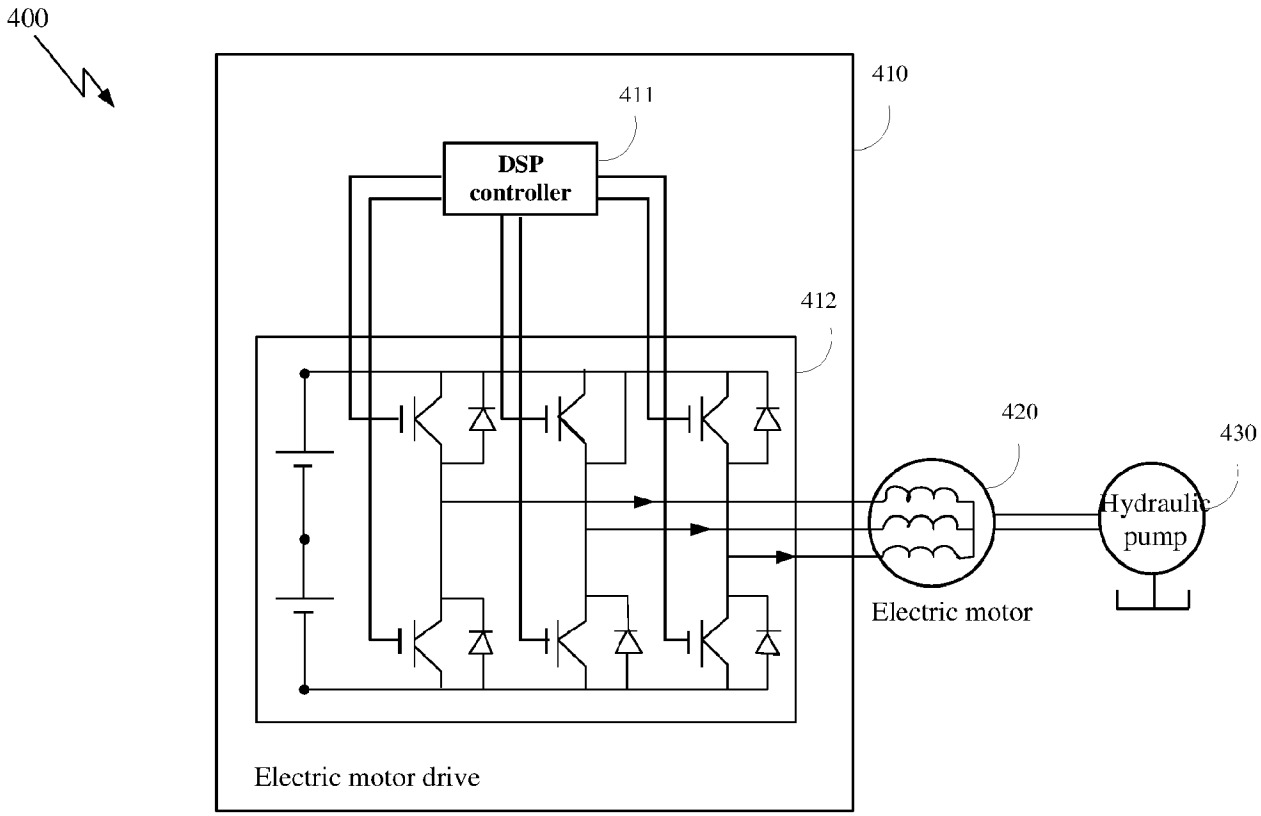
FIG. 4 illustrates a schematic diagram of the hydraulic pump system according to an embodiment of the present invention.

Now referring to FIG. 4, it illustrates a schematic diagram of a hydraulic pump system 400 according to an embodiment of the present invention. As shown, the hydraulic pump system 400 comprises an electric motor controller 410, an electric motor 420, and a hydraulic pump 430, wherein the electric motor controller 410 controls the operation of the electric motor 420 and the electric motor 420 drives the hydraulic pump 430.

The hydraulic pump 430 may be any appropriate hydraulic pump applicable in any actual situation, such as a piston pump, external gear pump, vane pump, etc. The electric motor 420 may be any appropriate electric motor suitable to be driven by a VFD, such as an AD servo electric motor. The electric motor controller 410 may also be called an electric motor drive, and is a VFD in an embodiment of the present invention. As shown in the figure and known by those skilled in the art, the VFD comprises a digital signal processing (DSP) controller 411 and an Insulated Gate Bipolar Transistor (IGBT) drive circuit 412. The DSP controller 411 generates a PWM signal based on a command of rotation speed, pressure or the like inputted by the user, and the PWM signal controls on and off of the transistors in the IGBT drive circuit 412 so as to drive the electric motor to rotate with an appropriate current and/or voltage.

The control system according to an embodiment of the present invention may be within the DSP controller 411 and implemented by software code in the DSP controller 411. Of course, it may also be contemplated that the software code has been hardwired into the DSP controller hardware, in which case, the control system will be implemented by hardware.

Figure 5:
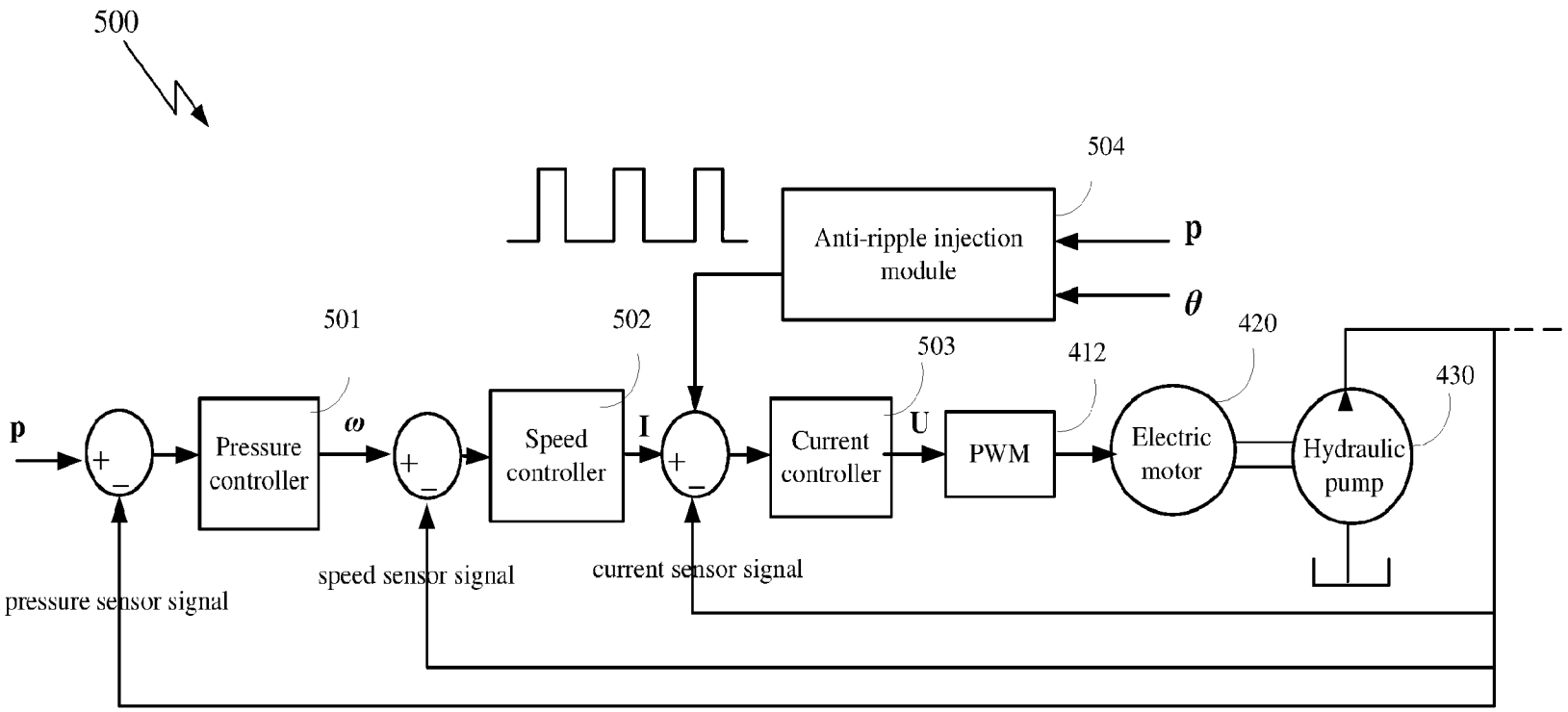
FIG. 5 illustrates a schematic diagram of the control system according to an embodiment of the present invention.

Now referring to FIG. 5, it illustrates a schematic diagram of the control system according to an embodiment of the present invention. As shown, the control system 500 comprises a pressure controller 501, a speed controller 502, a current controller 503, and an anti-ripple injection module 504.

The pressure controller 501 receives a combination of a fourth control signal (e.g. a target pressure value at the outlet of the hydraulic pump, set by the user) and a pressure feedback signal from a pressure sensor at the outlet of the hydraulic pump as input, and outputs a third control signal. The pressure controller 501 may be any appropriate existing (or newly developed) pressure controller, such as a PID (Proportion Integration Differentiation) controller.

The speed controller 502 receives a combination of the third control signal outputted by the pressure controller 501 and a speed feedback signal from a speed sensor at the output of the electric motor as input, and outputs a second control signal. The speed controller 502 may be any appropriate existing (or newly developed) speed controller, such as, a PI (Proportion Integration) controller.

The current controller 503 receives a combination of the second control signal outputted by the speed controller 502, a current feedback signal from a current sensor at the input of the electric motor and a current anti-ripple signal from the anti-ripple injection module 504 as input, and outputs a first control signal. The first control signal drives the electric motor to rotate via a PWM drive circuit (i.e. IGBT drive circuit), and the electric motor in turn drives the hydraulic pump to operate. The current controller 502 may be any appropriate existing (or newly developed) current controller, such as, a PI (Proportion Integration) controller. The current at the input of the electric motor is in proportion to the torque of the electric motor, so that control of the current is equivalent to control of the torque, and the current controller may also be called a torque controller.

According to an embodiment of the present invention, the anti-ripple injection module 504 generates the current anti-ripple signal based on a rotation angle signal 9 of the motor shaft, a rotation speed signal co of the electric motor, and an outlet pressure signal p of the hydraulic pump, and injects the current anti-ripple signal into the current loop of the control system, that is, the anti-ripple signal is combined with the second control signal and the current feedback signal at the input of the current controller 503 to be provided to the current controller 503. The rotation angle signal θ of the motor shaft may come from an angle sensor or position sensor installed on the electric motor; the rotation speed signal ω of the electric motor may come from a speed sensor installed on the electric motor or may be obtained by computing the changing rate over time of the angle signal θ; and the outlet pressure signal p of the hydraulic pump may come from a pressure sensor installed at the output of the hydraulic pump.

Figure 6:
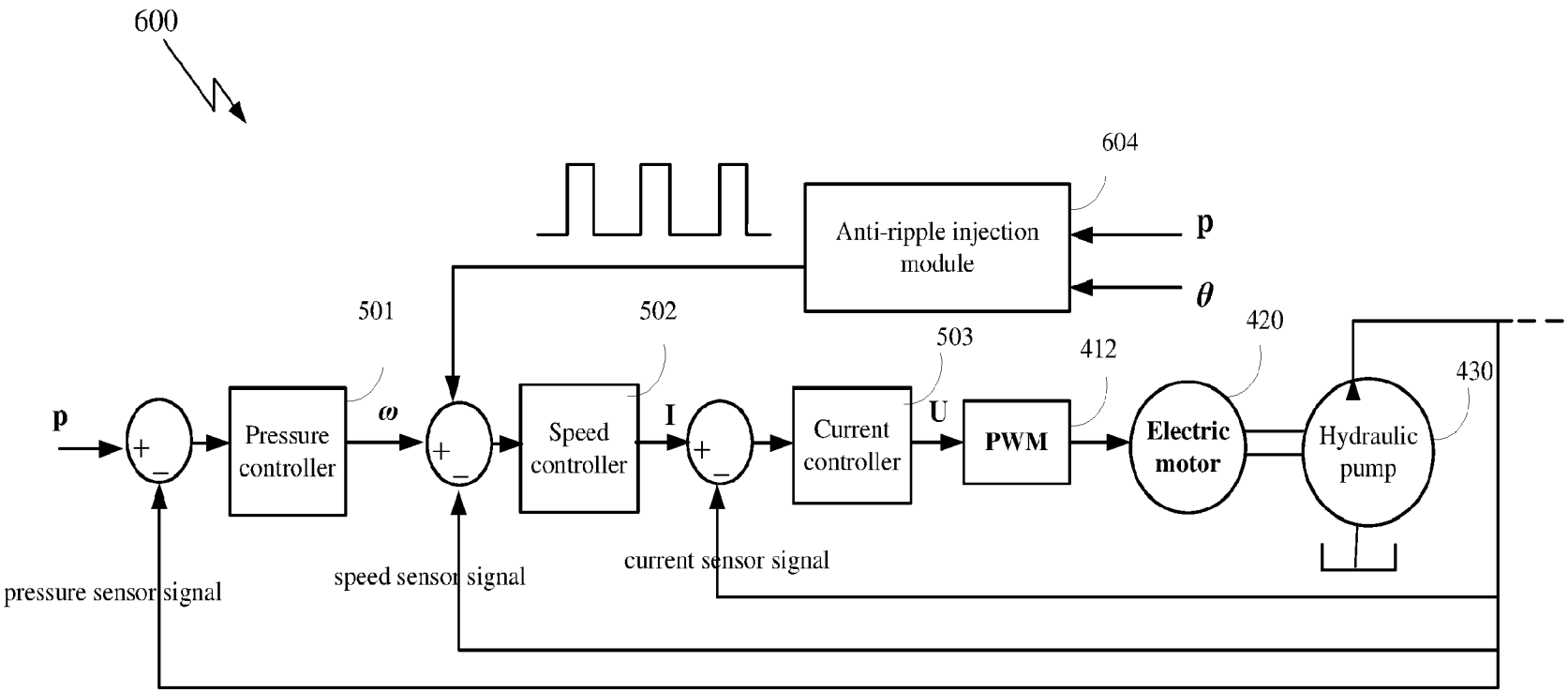
FIG. 6 illustrates a schematic diagram of the control system according to another embodiment of the present invention.

Now referring to FIG. 6, it illustrates a schematic diagram of the control system according to another embodiment of the present invention. As shown, the control system comprises a pressure controller 501, a speed controller 502, a current controller 503, and an anti-ripple injection module 604. The control system differs from the control system shown by FIG. 5 in that the anti-ripple injection module 604 injects a speed anti-ripple signal into the speed loop instead of the current loop.

The pressure controller 501 is the same as the pressure controller 501 shown in FIG. 5, and is not described further in detail.

The speed controller 502 receives a combination of a third control signal outputted by the pressure controller 501, a speed feedback signal from a speed sensor at the output of the electric motor and a speed anti-ripple signal from the anti-ripple injection module 604 as input, and outputs a second control signal.

The current controller 503 receives a combination of the second control signal outputted by the speed controller 502 and a current feedback signal from a current sensor at the input of the electric motor as input, and outputs a first control signal. The first control signal drives the electric motor to rotate via the PWM drive circuit (i.e. IGBT drive circuit), which in turn drives the hydraulic pump to operate.

According to this embodiment of the present invention, the anti-ripple injection module 604 generates a speed anti-ripple signal based on a rotation angle signal θ of the motor shaft, a rotation speed signal ω of the electric motor, and an outlet pressure signal p of the hydraulic pump, and injects the speed anti-ripple signal into the speed loop of the control system, that is, the anti-ripple signal is combined with the second control signal and the current feedback signal at the input of the current controller 503 to be provided to the current controller 503.

According to an embodiment of the present invention, the core module of the present invention is the anti-ripple injection module 504, 604. All the other modules may be a conventional implementation of the "pressure closed-loop control" that has been widely used in industrial machines and other related applications. In addition, as known by those skilled in the art, the structure of the control system illustrated in FIGS. 5 and 6 and described above is only exemplary, rather than limitation to the present invention. For example, the positional relation between the pressure controller 501 and the speed controller 502 may be contrary to that is illustrated and described; the control system may not include any or both of the pressure controller 501 and the speed controller 502; the control system may also include other controllers, other components or control loops, and so on.

Choice between the two embodiments (i.e. injecting the speed anti-ripple signal into the speed loop or injecting the current anti-ripple signal into the current loop) of the present invention described above depends on the frequency of the outlet pressure (or flow) ripples of the hydraulic pump in the time domain. In general, the current control loop has a much higher bandwidth (up to 1 KHz) than that of the speed control loop (about 100 Hz). As a rule of thumb, for a piston pump with 9 pistons, the speed anti-ripple signal injection method may be adopted when the rotating speed is less than 300 rpm, and the current anti-ripple signal injection method may be adopted when the rotating speed is less than 3000 rpm.

As described above, the function of the anti-ripple injection modules 504, 604 is to obtain the pressure signal from a pressure sensor and the angle signal from an angle sensor, and thereby, to compute an anti-ripple signal to modify the second or third control signal. As ripple generation in flow and pressure outputted by the hydraulic pump depends on the internal structure of the hydraulic pump, according to an embodiment of the present invention, the anti-ripple signal generated by the anti-ripple injection module 504, 604 is a periodic function of the rotation angle of the motor shaft instead of a periodic function of time. The waveform of the anti-ripple signal may be a conventional waveform, such as a square waveform, triangle waveform, and sinusoid waveform or the like. Taking a piston pump as an example, the anti-ripple signal of a sinusoid waveform can be expressed as follows:

$$f(\theta)=A_0 \operatorname{Cos}(2N\theta+\theta_0),$$

wherein θ is the rotation angle of the motor shaft, N is the number of pistons, $A_0$ and $\theta_0$ are the parameters to be determined.

The parameters of the periodic function can be determined in various ways. Both theories and experimental results have shown that $\theta_0$ is directly related to the mechanical structure of the pump and only needs to be measured once and is fixed. $A_0$ is a parameter depending on the operation state (including the rotation speed of the electric motor and outlet pressure of the hydraulic pump) of the electric motor and the hydraulic pump.

According to embodiments of the present invention, a method for determining the parameters is to conduct sufficient tests to build a lookup table and to determine the parameters of the periodic function using the lookup table. Specifically, during the tests, for each combination in a great amount of combinations of different measured values of the rotation speed ω of the electric motor and the outlet pressure p of the hydraulic pump, different combinations of values of parameters $A_0$ and $\theta_0$ are designated, and anti-ripple signals with different combinations of parameter values are injected into the control path of the control system. And ripples in the outlet pressures of the hydraulic pump are measured to obtain a combination of parameter values that produce a minimum outlet pressure ripple. In this way, the lookup table can be built, which lists the mapping relations between different combinations of measured values of the rotation speed w of the electric motor and the output pressure p of the hydraulic pump and appropriate values of the parameters $A_0$ and $\theta_0$. Thus, during the operation of the hydraulic pump system, the anti-ripple injection modules 504, 604 may look up in the lookup table for the values of the corresponding parameters $A_0$ and $\theta_0$ based on the measured rotation speed ω of the electric motor and the output pressure p of the hydraulic pump, and then produce an anti-ripple signal with the parameter values to be injected into the control path of the control system. In this method, as the lookup table including parameter values is formed in the tests before the actual production operation of the hydraulic pump system, this method may be called an off-line determination method.

According to some other embodiments of the present invention, an adaptive tuning algorithm may also be used to determine the parameters of the periodic function. The adaptive tuning algorithm may be any known adaptive control method, such as, the Least Mean Square (LMS) method or the Recursive Least Square (RLS) method or the like. The basic idea of such methods is to actively set different parameters to the system, measure output results of system with the different parameters, and identify system parameters based on the change pattern and distribution of the output results. In the embodiments of the present invention, the adaptive tuning algorithm may, for any specific combination of measured values of the rotation speed co of the electric motor and the output pressure p of the hydraulic pump, obtain appropriate values of parameters $A_0$ and $\theta_0$ by continuously setting and adjusting parameter values $A_0$ and $\theta_0$ and measuring ripples in the corresponding outlet pressures of the hydraulic pump. This method can identify the parameters of the periodic function in the actual production operation of the hydraulic pump, thus it is an on-line method. Such adaptive tuning algorithms are well known in the art, so are not further described in detail.

A hydraulic pump system and a VFD-based hydraulic pump control system according to embodiments of the present invention are described above by referring to the figures. It should be pointed out that the description above is only exemplary, not limitation to the present invention. In other embodiments of the present invention, the system may have more, less or different modules, and the including, connecting and functional relations among these modules may be different from that described.

As may be known by those skilled in the art based on the description above, the present invention further provides a control method of a VFD-based hydraulic pump, the control method controlling an electric motor via a VFD, the electric motor driving the pump, the control method comprising: injecting an anti-ripple signal into a control path, the anti-ripple signal causing pressure ripples in the pump output to be at least partially cancelled.

According to an embodiment of the present invention, the control path comprises a current controller which receives a combination of a second control signal and a current feedback signal from a current sensor at the input of the electric motor and provides a first control signal to the electric motor.

According to an embodiment of the present invention, the anti-ripple signal is combined with the second control signal and the current feedback signal to be provided to the current controller.

According to an embodiment of the present invention, the control path further comprises a speed controller which receives a combination of a third control signal and a speed feedback signal from a speed sensor at the output of the electric motor, and directly or indirectly provides the second control signal to the current controller, wherein, the anti-ripple signal is combined with the third control signal and the speed feedback signal to be provided to the speed controller.

According to an embodiment of the present invention, the control path further comprises a pressure controller which receives a combination of a fourth control signal and a pressure feedback signal from a pressure sensor at the output of the pump, and directly or indirectly provides the second control signal to the current controller.

According to an embodiment of the present invention, the anti-ripple signal is a periodic function of the rotation angle of the motor shaft.

According to an embodiment of the present invention, parameters of the periodic function are adaptively determined from pressure measurements at the output of the pump and rotation speed measurements at the output of the electric motor.

According to an embodiment of the present invention, parameters of the periodic function are determined via a lookup table which maps multiple combinations of the pressure measurements and the rotation speed measurements to corresponding parameters of the periodic function.

According to an embodiment of the present invention, the control method further comprises: building the look-up table in an off-line test method in which, for each of the multiple combinations of the pressure measurements and the rotation speed measurements, parameters of the periodic function are adaptively adjusted until pressure ripples in the pump output are at least partially cancelled, thus obtaining parameters of the periodic function corresponding to each of the multiple combinations of the pressure measurements and the rotation speed measurements.

According to an embodiment of the present invention, parameters of the periodic function are determined using an online adaptive algorithm in which, for each of the multiple combinations of the pressure measurements and the rotation speed measurements, parameters of the periodic function are adaptively adjusted until pressure ripples in the pump output are at least partially cancelled.

According to an embodiment of the present invention, the pump is a piston pump, and the anti-ripple signal is represented as:

$$f(\theta)=A_0 \cos(2N\theta+\theta_0),$$

wherein $\theta$ is the rotation angle of the motor shaft, N is the number of pistons, $A_0$ and $\theta_0$ are the parameters to be determined.

The control method and control system can be validated by building a test demo hydraulic pump system and running the control method and control system thereon according to embodiments of the present invention. The test demo hydraulic pump system may comprise a programmable VFD, an AC servo motor and a dual-displacement Eaton 420 industrial pump, wherein the maximum current of the VFD is 120 A; the rated rotation speed of the electric motor is 1500 rpm; the rated torque is 108 Nm; the rated current is 53.3 A; the inertia (+pump) is 0.079 kgm2; the pump max displacement is 49 cc.

The anti-ripple signal injection is performed on the speed loop. The duty cycle is a pressure holding @154 bar. The pump displacement during pressure holding is set to about 25 cc. The motor rotation speed is observed to be around 125 rpm to supply the system leakage flow. The injected signal is chosen to be a sinusoid signal. The amplitude $A_0$ and phase $\theta_0$ are determined through a lookup table from sufficient tests.

Figure 7:
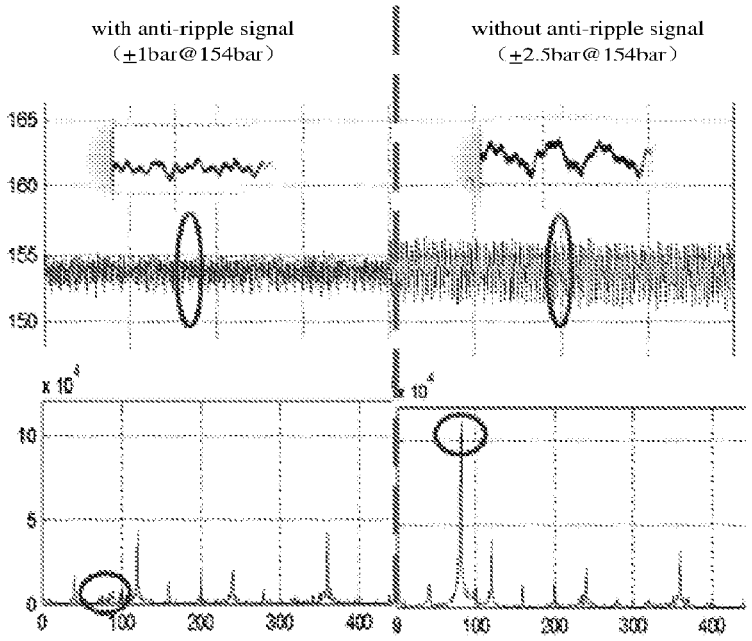
FIG. 7 illustrates a diagram of measured data from a pressure sensor in a test demo hydraulic pump system.

FIG. 7 illustrates a diagram of measured data from pressure sensors in a test demo hydraulic pump system. The upper part of the diagram shows a comparison between the pressure signal with anti-ripple signal injection of the present invention and the pressure signal without anti-ripple signal injection of the present invention. As can be seen from the figure, the anti-ripple signal injection of the present invention is able to reduce as much as 60% of pressure ripples. The lower part of the diagram is a spectrum analysis of the ripple signals. From the figure, it can be seen that the ripples comprise only a portion of the harmonics. The most significant harmonic (2nd harmonic) is completely cancelled by the anti-ripple signal injection of the present invention, which contributes to pressure ripple reduction.

Although exemplary embodiments of the present invention are described above, the present invention is not limited to this. Those skilled in the art may make various changes and modifications without departing from the spirit and scope of the present invention. For example, it is contemplated that the technical solution of the present invention may also be applicable to other fluid pumps than hydraulic pumps. The scope of the present invention is only defined by the claims.

The invention claimed is:

1. A control system of a variable frequency drive (VFD) based hydraulic pump, the control system controlling an electric motor via a VFD, the electric motor driving the pump, the control system comprising:

an anti-ripple injection module for injecting an anti-ripple signal into a control path, the anti-ripple signal causing pressure ripples in a pump output to be at least partially cancelled, wherein the anti-ripple signal is a periodic function of a rotation angle of a motor shaft; and a current controller which receives a combination of a second control signal and a current feedback signal from a current sensor at an input of the electric motor, and provides a first control signal to the electric motor, wherein the second control signal is received from a speed controller which receives a combination of a third control signal and a speed feedback signal from a speed sensor at an output of the electric motor, wherein the third control signal is an output from a pressure controller;

wherein the anti-ripple injection module combines the anti-ripple signal with the second control signal and the current feedback signal at the current controller.

2. The control system according to claim 1, further comprising the pressure controller which receives a combination of a fourth control signal and a pressure feedback signal from a pressure sensor at the output of the pump, and directly or indirectly provides the second control signal to the current controller.

3. The control system according to claim 1, wherein parameters of the periodic function are adaptively determined from pressure measurements at the output of the pump and rotation speed measurements at the output of the electric motor.

4. The control system according to claim 3, wherein the parameters of the periodic function are determined via a look-up table which maps multiple combinations of the pressure measurements and the rotation speed measurements to corresponding parameters of the periodic function.

5. The control system according to claim 3, wherein the parameters of the periodic function are determined using an online adaptive algorithm in which, for each of the multiple combinations of the pressure measurements and the rotation speed measurements, the parameters of the periodic function are adaptively adjusted until the pressure ripples in the pump output are at least partially cancelled.

6. The control system according to claim 1, wherein the pump is a piston pump, and the anti-ripple signal is represented as:

$$f(\theta)=A_0 \operatorname{Cos}(2N\theta+\theta_0),$$

wherein θ is the rotation angle of the motor shaft, N is the number of pistons, $A_0$ and $\theta_0$ are parameters obtained from a lookup table.

7. A control method of a variable frequency drive (VFD) based pump, the control method controlling an electric motor via a VFD, the electric motor driving the pump, the control method comprising:

injecting an anti-ripple signal into a control path, the anti-ripple signal causing pressure ripples in a pump output to be at least partially cancelled, wherein the anti-ripple signal is a periodic function of a rotation angle of a motor shaft; and receiving by a current controller a combination of a second control signal and a current feedback signal from a current sensor at an input of the electric motor, and providing a first control signal to the electric motor, wherein the second control signal is received from a speed controller which receives a combination of a third control signal and a speed feedback signal from a speed sensor at an output of the electric motor, wherein the third control signal is an output from a pressure controller;

wherein an anti-ripple injection module combines the anti-ripple signal with the second control signal and the current feedback signal at the current controller.

8. The control method according to claim 7, wherein the control path further comprises the pressure controller which receives a combination of a fourth control signal and a pressure feedback signal from a pressure sensor at the output of the pump, and directly or indirectly provides the second control signal to the current controller.

9. The control method according to claim 7, wherein parameters of the periodic function are adaptively determined from pressure measurements at the output of the pump and rotation speed measurements at the output of the electric motor.

10. The control method according to claim 9, wherein the parameters of the periodic function are determined via a look-up table which maps multiple combinations of the pressure measurements and the rotation speed measurements to corresponding parameters of the periodic function.

11. The control method according to claim 10, further comprising: establishing the look-up table in an off-line test method in which, for each of the multiple combinations of the pressure measurements and the rotation speed measurements, the parameters of the periodic function are adaptively adjusted until the pressure ripples in the pump output are at least partially cancelled, thus obtaining the parameters of the periodic function corresponding to each of the multiple combinations of the pressure measurements and the rotation speed measurements.

12. The control method according to claim 9, wherein the parameters of the periodic function are determined using an online adaptive algorithm in which, for each of the multiple combinations of the pressure measurements and the rotation speed measurements, the parameters of the periodic function are adaptively adjusted until the pressure ripples in the pump output are at least partially cancelled.

13. The control method according to claim 7, wherein the pump is a piston pump, and the anti-ripple signal is represented as:

$$f(\theta)=A_0 \operatorname{Cos}(2N\theta+\theta_0),$$

wherein θ is the rotation angle of the motor shaft, N is the number of pistons, $A_0$ and $\theta_0$ are parameters obtained from a lookup table.

14. A pump system, comprising:

a variable frequency drive (VFD), an electric motor, a pump, and a control system having:

an anti-ripple injection module for injecting an anti-ripple signal into a control path, the anti-ripple signal causing pressure ripples in a pump output to be at least partially cancelled, the anti-ripple signal is a periodic function of a rotation angle of a motor shaft, and wherein parameters of the periodic function are adaptively determined from pressure measurements at the output of the pump and rotation speed measurements at an output of the electric motor;

a current controller which receives a combination of a second control signal, a current feedback signal from a current sensor at an input of the electric motor, and the anti-ripple signal from the anti-ripple injection module, and outputs a first control signal to the electric motor, wherein the anti-ripple injection module combines the anti-ripple signal with the second control signal and the current feedback signal at the current controller;

a speed controller which receives a combination of a third control signal and a speed feedback signal from a speed sensor at the output of the electric motor, and outputs the second control signal to the current controller;

a pressure controller which receives a combination of a fourth control signal and a pressure feedback signal from a pressure sensor at an outlet of the pump, and provides the third control signal to the speed controller, wherein the fourth control signal is a target pressure value at the outlet of the pump.

* * * * *